US005542825A

United States Patent [19]

Perrillat-Amede et al.

[11] Patent Number: 5,542,825

[45] Date of Patent: Aug. 6, 1996

[54] TURBOMOLECULAR VACUUM PUMP

[75] Inventors: Denis Perrillat-Amede, Annecy; Didier Pierrejean, Villaz; Francois Reverdy, Annecy, all of France

[73] Assignee: Alcatel CIT, Paris, France

[21] Appl. No.: 516,939

[22] Filed: Aug. 18, 1995

[30] Foreign Application Priority Data

Aug. 19, 1994 [FR] France ..... 94 10147

[51] Int. Cl.[6] ..... F04D 19/04

[52] U.S. Cl. ..... 417/423.4; 417/423.7

[58] Field of Search ..... 417/423.4, 423.7; 415/90; 310/42, 156

[56] References Cited

U.S. PATENT DOCUMENTS

| | | | |
|---|---|---|---|
| 3,535,052 | 10/1970 | Becker et al. | 417/423.4 |
| 4,111,595 | 9/1978 | Becker et al. | 415/90 |
| 4,433,261 | 2/1984 | Nashiki et al. | 310/156 |
| 4,588,914 | 5/1986 | Heyne | 310/156 |
| 4,629,921 | 12/1986 | Gavaletz | 310/156 |
| 4,725,750 | 2/1988 | Welch | 310/156 |
| 4,787,829 | 11/1988 | Miyazaki et al. | 417/423.4 |
| 5,059,092 | 10/1991 | Kabelite et al. | 417/423.4 |
| 5,106,273 | 4/1992 | Lemarquand et al. | 417/423.4 |
| 5,152,679 | 10/1992 | Kanemitsu et al. | 417/423.4 |
| 5,350,275 | 9/1994 | Ishimaru | 417/423.4 |

FOREIGN PATENT DOCUMENTS

| | | | |
|---|---|---|---|
| 0470637A1 | 2/1992 | European Pat. Off. . | |
| 3713534A1 | 11/1987 | Germany . | |
| 0282192 | 12/1987 | Japan | 415/90 |
| 477629 | 10/1989 | Switzerland . | |

*Primary Examiner*—Louis J. Casaregola
*Assistant Examiner*—William Wicker
*Attorney, Agent, or Firm*—Sughrue, Mion, Zinn, Macpeak & Seas

[57] ABSTRACT

A turbomolecular pump comprising a stator and a rotor, said rotor comprising a central shaft and a bell-shaped active portion, said stator comprising an outer portion and an inner portion that penetrates into the cavity of said bell-shaped active portion, and that supports the stator portion of the drive motor, the shaft of said rotor supporting the rotor portion of said drive motor, wherein said central shaft and the bell-shaped active portion of the rotor are made in one piece, without any assembly being necessary, and of a non-magnetic material, said shaft being provided with a central bore which receives the rotor portion of said drive motor, which portion is constituted by a cylindrical permanent magnet.

2 Claims, 1 Drawing Sheet

TURBOMOLECULAR VACUUM PUMP

The present invention relates to a turbomolecular pump comprising a stator and a rotor, the rotor comprising a central shaft and a bell-shaped active portion, the stator comprising an outer portion and an inner portion that penetrates into the cavity of said bell-shaped active portion, and that supports the stator portion of the drive motor, the shaft of the rotor supporting the rotor portion of the drive motor.

BACKGROUND OF THE INVENTION

In a known pump of this type, the rotor of the electric drive motor is fixed around the central shaft which is itself mounted on the active portion itself by means of a screw, the rotor of the electric motor being made up, depending on the type of motor, of coils, and of iron or of permanent magnets. The permanent-magnet motor is generally preferred because of its efficiency, its compactness, and the stability of its speed of rotation.

It is known that, in order to obtain better delivery-rates and compression ratios, it is necessary to increase the speed of rotation of the machine, these performance levels of the machine being proportional to its speed of rotation.

Speed of rotation is limited both by the strength of the materials used to make the rotor, and also by the dynamic behavior of the rotor, which behavior is linked inter alia to the rigidity of the rotor.

Furthermore, in order to integrate pumps into equipment, such as leak detectors or gas analyzers, it is necessary to make them as small as possible. Another important factor is degassing of the constituent parts of the pump, because the limit pressure depends in part on such degassing. It is particularly necessary to minimize such degassing at the suction end.

The rotor assembly of such a known pump is difficult to make rigid, it is bulky, costly, and difficult to degas. In particular, it is difficult to obtain good rigidity for the shaft-active portion assembly, and good resistance to centrifugal forces for the permanent magnets. It is necessary to secure the magnets firmly.

OBJECTS AND SUMMARY OF THE INVENTION

An object of the present invention is to provide a pump having a rotor that is rigid, that is compact, and that has low degassing. It is to be understood that a "rigid" rotor is a rotor having a first bending mode frequency that is much higher than the rotation frequency of the pump.

To this end, the invention provides a turbomolecular vacuum pump, as defined above, wherein said central shaft and said bell-shaped active portion of the rotor are made in one piece, without any assembly being necessary, and of a non-magnetic material, said shaft being provided with a central bore which receives the rotor portion of said drive motor, which portion is constituted by a cylindrical permanent magnet.

Advantageously, said permanent magnet has a cross-section that is circular with two diametrically opposite flats. This disposition enables air to removed on inserting the magnet into the bore in the shaft.

BRIEF DESCRIPTION OF THE DRAWING

An embodiment of the invention is described below with reference to the accompanying drawing, in which.

MORE DETAILED DESCRIPTION

Figure 1:
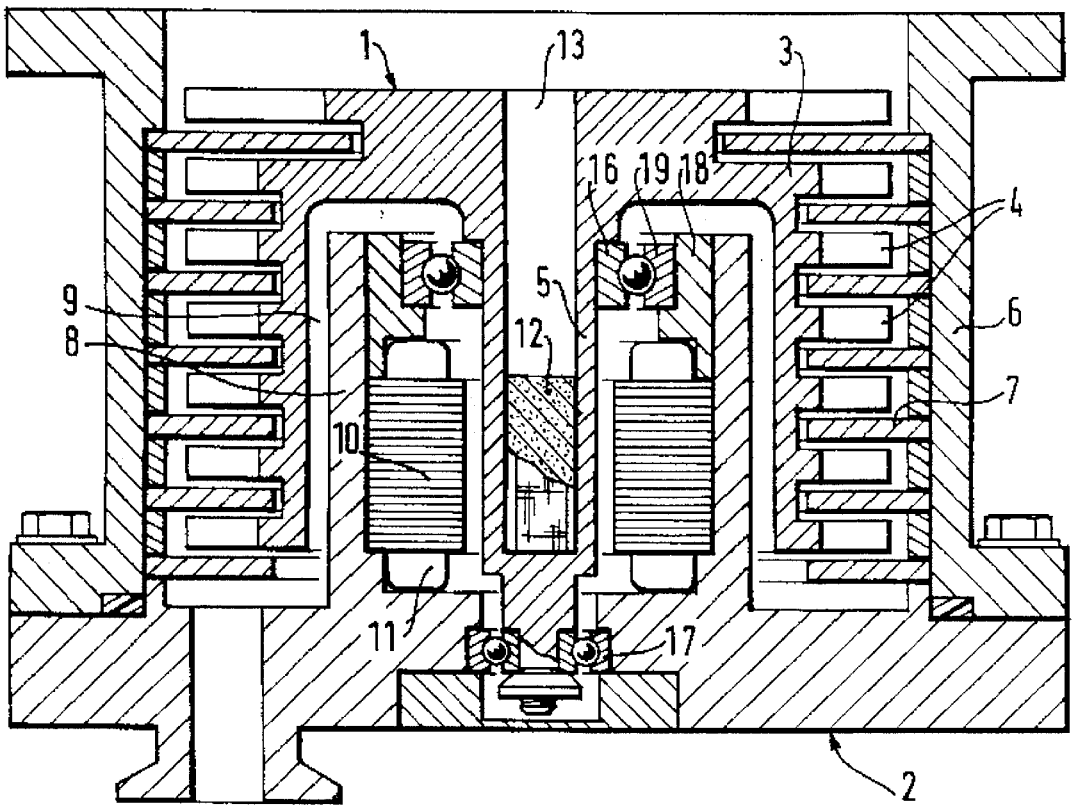
FIG. 1 is an axial section through a turbomolecular pump of the invention.

FIG. 1 shows a turbomolecular vacuum pump of the type having fins. This pump comprises a rotor 1 and a stator 2. The rotor 1 comprises a central shaft 5 and an active portion 3 that is bell-shaped and that is provided with fins 4. The active portion 3 with its fins 4 and the central shaft 5 are made in one piece, without any assembly being necessary, and of a non-magnetic material. The stator 2 is made in two assembled-together portions: an outer portion 6 in which fixed fin stages 7 are mounted, and an inner portion 8 which penetrates into the cavity 9 in the bell-shaped active portion 3 of the rotor 1.

The inner portion 8 of the stator carries the stator portion of an electric drive motor, which stator portion comprises a magnetic circuit 11 and windings 10. The rotor portion of the drive motor is constituted by a single cylindrical multipolar permanent magnet 12 inserted to the end of a central bore 13 in the central shaft 5.

Figure 2:
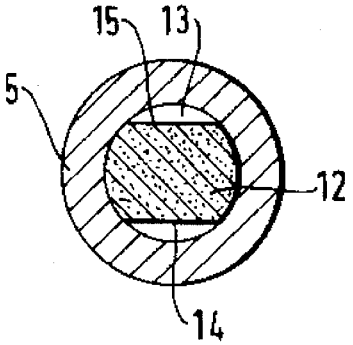
FIG. 2 is a cross-section through the permanent magnet used as the rotor of the electric drive motor.

As shown in FIG. 2, the permanent magnet 12 has a cross-section that is circular, but with two diametrically opposite flats 14 and 15 so as to enable air to be removed on inserting the magnet into the bore 13.

The rotor 1 is supported in the stator by two ball bearings 16 and 17. A spacer 18 makes it possible to match the diameter of the inner portion 8 of the stator to the diameter of the outer ring 19 of bearing 16.

Figure 3:
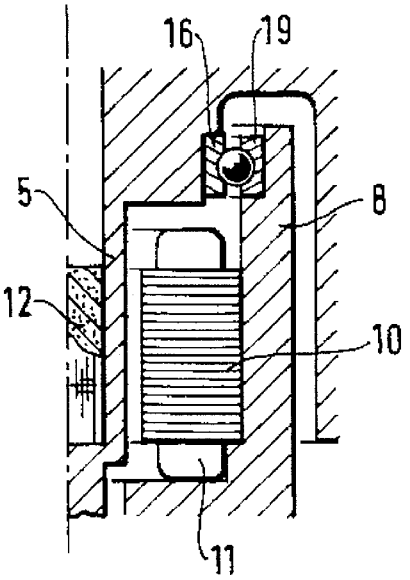
FIG. 3 shows a slight variant concerning assembly.

If the diameter of the outer ring 19 of bearing 16 is greater than the diameter of the magnetic circuit 11, then the spacer 18 can be omitted, as shown in FIG. 3.

Naturally, the pump described is a pump having fins, but the invention can .just as well be applied to molecular drag pumps of the Holweck type having drums, and the term "turbomolecular pump" that is used covers both pumps having fins and Holweck-type pumps.

By means of its one-piece rotor, not requiring any assembly, and by having the rotor of its drive motor constituted by a single cylindrical permanent magnet and received in a central bore of the shaft instead of being situated around the central shaft, the pump of the invention offers excellent rotary-assembly rigidity, improved compactness and lower cost, and it minimizes the internal degassing of the pump at its suction end.

We claim:

1. A turbomolecular pump comprising a stator and a rotor and a drive motor having a rotor portion and a stator portion, said rotor comprising a central shaft and a bell-shaped active portion, said stator comprising an outer portion and an inner portion that penetrates into the cavity of said bell-shaped active portion, and that supports the stator portion of the drive motor, the shaft of said rotor supporting the rotor portion of said drive motor, wherein said central shaft and the bell-shaped active portion of the rotor are made in one piece, without any assembly being necessary, and of a non-magnetic material, said shaft being provided with a central bore which receives the rotor portion of said drive motor, which portion is constituted by a cylindrical permanent magnet.

2. A turbomolecular vacuum pump according to claim 1, wherein said permanent magnet has a cross-section that is circular with two diametrically opposite flats.

* * * * *